US010736819B1

(12) United States Patent
Nowosielski et al.

(10) Patent No.: US 10,736,819 B1
(45) Date of Patent: Aug. 11, 2020

(54) PILL DETECTION AND COUNTING MACHINE

(71) Applicant: SCIENTIFIC INDUSTRIES INC., Bohemia, NY (US)

(72) Inventors: Karl Damian Nowosielski, Pearl River, NY (US); Lukasz Grabowski, Grajewo (PL)

(73) Assignee: SCIENTIFIC INDUSTRIES INC., Bohemia, NY (US)

( * ) Notice: Subject to any disclaimer, the term of this patent is extended or adjusted under 35 U.S.C. 154(b) by 0 days.

(21) Appl. No.: 16/295,259

(22) Filed: Mar. 7, 2019

(51) Int. Cl.
*A61J 7/02* (2006.01)

(52) U.S. Cl.
CPC ..... *A61J 7/02* (2013.01)

(58) Field of Classification Search
CPC ..... A61J 7/02
See application file for complete search history.

(56) References Cited

U.S. PATENT DOCUMENTS

| | | | | |
|---|---|---|---|---|
| 7,599,516 | B2 | 10/2009 | Limer et al. | |
| 8,215,557 | B1 | 7/2012 | Reno et al. | |
| 8,682,047 | B2 * | 3/2014 | Lang | G06K 9/3241 382/128 |
| 9,375,079 | B2 * | 6/2016 | Ranalletta | H04N 7/18 |

* cited by examiner

*Primary Examiner* — Patrick O Neill
(74) *Attorney, Agent, or Firm* — F. Chau & Associates, LLC

(57) ABSTRACT

Systems and methods are described for counting objects by analyzing a digital image. The system or apparatus may include a light source, a digital camera, a textured surface disposed between the light source and the visible light camera, a processing component configured to produce a count of the objects, and a display configured to show the count of the objects. The method may include capturing an electronic image of the objects, detecting a plurality of edges within the image, identifying a plurality of concave sections based on the edges, identifying a regular convex contours based on the edges and the concave sections, determining whether the image is suitable for counting the objects based on the regular convex contours, and determining a count of the objects based the regular convex contours and the determination of whether the image is suitable.

20 Claims, 13 Drawing Sheets

500

PILL DETECTION AND COUNTING MACHINE

BACKGROUND

The following relates generally to counting objects, and more specifically to counting objects by analyzing a digital image.

Counting objects is an important task in many industries. For example, in a pharmacy the task of counting pills is repeated many times each day. However, in many cases this task is performed manually, which may be time consuming and may lead to mistakes, Additionally, systems that perform counting tasks automatically are often suitable only for a very particular size and shape of object, or may require extensive training of an object recognition pattern, Systems based on object specific pattern recognition may also be costly, or may be of limited usefulness when counting objects with different sizes, shapes, or coloration.

SUMMARY

An apparatus for counting objects by analyzing a digital image is described. The apparatus may include a light source, a digital camera, a textured surface disposed between the light source and the visible light camera, wherein the textured surface is configured to separate the objects, a processing component configured to produce a count of the objects based at least in part on detecting regular convex contours within an image provided by the digital visible light camera, and a display configured to show the count of the objects.

A process for manufacturing an apparatus for counting objects is described. The process may include providing a light source, providing a digital camera, providing a textured surface disposed between the light source and the visible light camera, wherein the textured surface is configured to separate the objects, providing a processing component configured to produce a count of the objects based at least in part on detecting regular convex contours within an image provided by the digital visible light camera, and providing a display configured to show the count of the objects.

A method of using an apparatus for counting objects is described. The method may include using a light source, using a digital camera, using a textured surface disposed between the light source and the visible light camera, wherein the textured surface is configured to separate the objects, using a processing component configured to produce a count of the objects based at least in part on detecting regular convex contours within an image provided by the digital visible light camera, and using a display configured to show the count of the objects.

Some examples of the apparatus, process, and method described above may further include a light diffuser disposed between the light source and the textured surface. In some examples of the apparatus, process, and method described above, the textured surface comprises a plurality of raised portions and a plurality of lowered portions arranged in a regular pattern. In some examples of the apparatus, process, and method described above, the regular pattern comprises a hexagonal tessellation pattern.

Some examples of the apparatus, process, and method described above may further include a first removable chute configured to collect one or more of the objects that have been counted. Some examples of the apparatus, process, and method described above may further include a second removeable chute configured to collect one or more of the objects that have been discarded.

In some examples of the apparatus, process, and method described above, the textured surface comprises a surface of a removable tray. In some examples of the apparatus, process, and method described above, the removeable tray is affixed to the apparatus by one or more posts configured to enable the removeable tray to pivot in at least one direction.

Some examples of the apparatus, process, and method described above may further include a filter disposed between the textured surface and the digital camera, wherein the filter is configured to filter out a first portion of reflected light and pass through a second portion of light from the light source, and wherein the portion comprises a higher ratio than the second portion. In some examples of the apparatus, process, and method described above, the digital camera comprises a visible light camera.

Some examples of the apparatus, process, and method described above may further include a shaking mechanism configured to separate the objects on the textured surface. In some examples of the apparatus, process, and method described above, the display comprises a touchscreen device configured to enable a user to provide operating inputs to the apparatus.

A method for counting objects by analyzing a digital image is described. The method may include capturing an electronic image of the objects, detecting a plurality of edges within the image, identifying a plurality of concave sections based at least in part on the plurality of edges, identifying a plurality of regular convex contours based at least in part on the plurality of edges and the plurality concave sections, determining whether the image is suitable for counting the objects based at least part on the plurality of regular convex contours, and determining a count of the objects based at least in part on the plurality of regular convex contours and the determination of whether the image is suitable for counting.

An apparatus for counting objects is described. The apparatus may include a processor, memory in electronic communication with the processor, and instructions stored in the memory. The instructions may be operable to cause the processor to capture an electronic image of the objects, detect a plurality of edges within the image, identify a plurality of concave sections based at least in part on the plurality of edges, identify a plurality of regular convex contours based at least in part on the plurality of edges and the plurality concave sections, determine whether the image is suitable for counting the objects based at least part on the plurality of regular convex contours, and determine a count of the objects based at least in part on the plurality of regular convex contours and the determination of whether the image is suitable for counting.

A non-transitory computer readable medium storing code for counting objects is described. In some examples, the code comprises instructions executable by a processor to: capture an electronic image of the objects, detect a plurality of edges within the image, identify a plurality of concave sections based at least in part on the plurality of edges, identify a plurality of regular convex contours based at least in part on the plurality of edges and the plurality concave sections, determine whether the image is suitable for counting the objects based at least part on the plurality of regular convex contours, and determine a count of the objects based at least in part on the plurality of regular convex contours and the determination of whether the image is suitable for counting.

Some examples of the method, apparatus, and non-transitory computer readable medium described above may further include placing the objects on a textured surface configured to separate the objects. Some examples of the method, apparatus, and non-transitory computer readable medium described above may further include capturing at least one additional electronic image of the objects. Some examples of the method, apparatus, and non-transitory computer readable medium described above may further include determining an independent count of the objects based on each of the at least one additional electronic images, Some examples of the method, apparatus, and non-transitory computer readable medium described above may further include determining whether the count of the objects and the independent counts of the objects are consistent. Some examples of the method, apparatus, and non-transitory computer readable medium described above may further include determining whether the count of the objects is reliable based at least in part on whether the count of the objects and the independent counts of the objects are consistent.

Some examples of the method, apparatus, and non-transitory computer readable medium described above may further include determining that the count of the objects is reliable. Some examples of the method, apparatus, and non-transitory computer readable medium described above may further include displaying the count of the objects to a user based at least in part on the determination that the count of the objects is reliable.

Some examples of the method, apparatus, and non-transitory computer readable medium described above may further include displaying an indication that the count is reliable other than the count of the objects. Some examples of the method, apparatus, and non-transitory computer readable medium described above may further include determining that the count of the objects is not reliable. Some examples of the method, apparatus, and non-transitory computer readable medium described above may further include displaying an indication to a user that the count of the objects is not reliable.

Some examples of the method, apparatus, and non-transitory computer readable medium described above may further include performing a separation action on the objects based at least in part on the determination that the count of the objects is not reliable. In some examples of the method, apparatus, and non-transitory computer readable medium described above, the separation action comprises a mechanical shaking motion. In some examples of the method, apparatus, and non-transitory computer readable medium described above, the separation action comprises a sweeping motion.

Some examples of the method, apparatus, and non-transitory computer readable medium described above may further include identifying one or more closed edges of the plurality of edges. Some examples of the method, apparatus, and non-transitory computer readable medium described above may further include determining that the one or more closed edges are below a threshold size. Some examples of the method, apparatus, and non-transitory computer readable medium described above may further include discarding the one or more closed edges based at least in part on the determination that the one or more closed edges are below the threshold size, wherein determining the count of the objects is based at least in part on discarding the one or more closed edges.

Some examples of the method, apparatus, and non-transitory computer readable medium described above may further include identifying one or more pixel groups, Some examples of the method, apparatus, and non-transitory computer readable medium described above may further include determining that the one or more pixel groups are below a threshold size. Some examples of the method, apparatus, and non-transitory computer readable medium described above may further include discarding the one or more pixel groups based at least in part on the determination that the one or more pixel groups are below the threshold size, wherein determining the count of the objects is based at least in part on discarding the one or more pixel groups.

In some examples of the method, apparatus, and non-transitory computer readable medium described above, the count of the objects is determined without reference to a geometric profile of the objects. In some examples of the method, apparatus, and non-transitory computer readable medium described above, the count of the objects is determined without reference to a training set of objects. Some examples of the method, apparatus, and non-transitory computer readable medium described above may further include transforming the electronic image to a black and white image, wherein the plurality of edges are detected based on the black and white image.

BRIEF DESCRIPTION OF THE DRAWINGS

FIG. 1 shows an example of a method for processing an image to count objects in accordance with aspects of the present disclosure.

DETAILED DESCRIPTION

The present disclosure describes systems and methods for counting objects using an imaging device. In some of the examples herein, the system may be described in the context of counting pills, but it is not limited thereto. Rather, the systems and methods may be used for counting a wide variety of objects and the example of counting pills is used for clarity and convenience. In one embodiment, the system may be configured to produce an object count using an image from a camera operating within the visible light spectrum (i.e., as opposed to an infrared camera). Furthermore, the system may utilize an image processing method based on detecting edges and hollows to determine the location and number of objects in an image.

In some examples, the system may be configured to operate on non-transparent objects. In some examples, the system may operate based on an image processing method that does not rely on a reference image of the object being counted, and that does not rely on image compression. In some examples, the image processing does not depend on geometric pattern matching other than edge and hollow detection. The system may be configured to count objects such as pills, tablets, or capsules, of almost any shape, size, or color.

In some cases, the counting algorithm may be configured to count the objects without relying on their size and shape (e.g., so it can count different pills on the single image), The system may utilize feedback based on how big the detected objects are (according to the algorithm), and that information may be available along with the output of the algorithm and used, for example, to tune the shaker mechanism.

Figure 1:
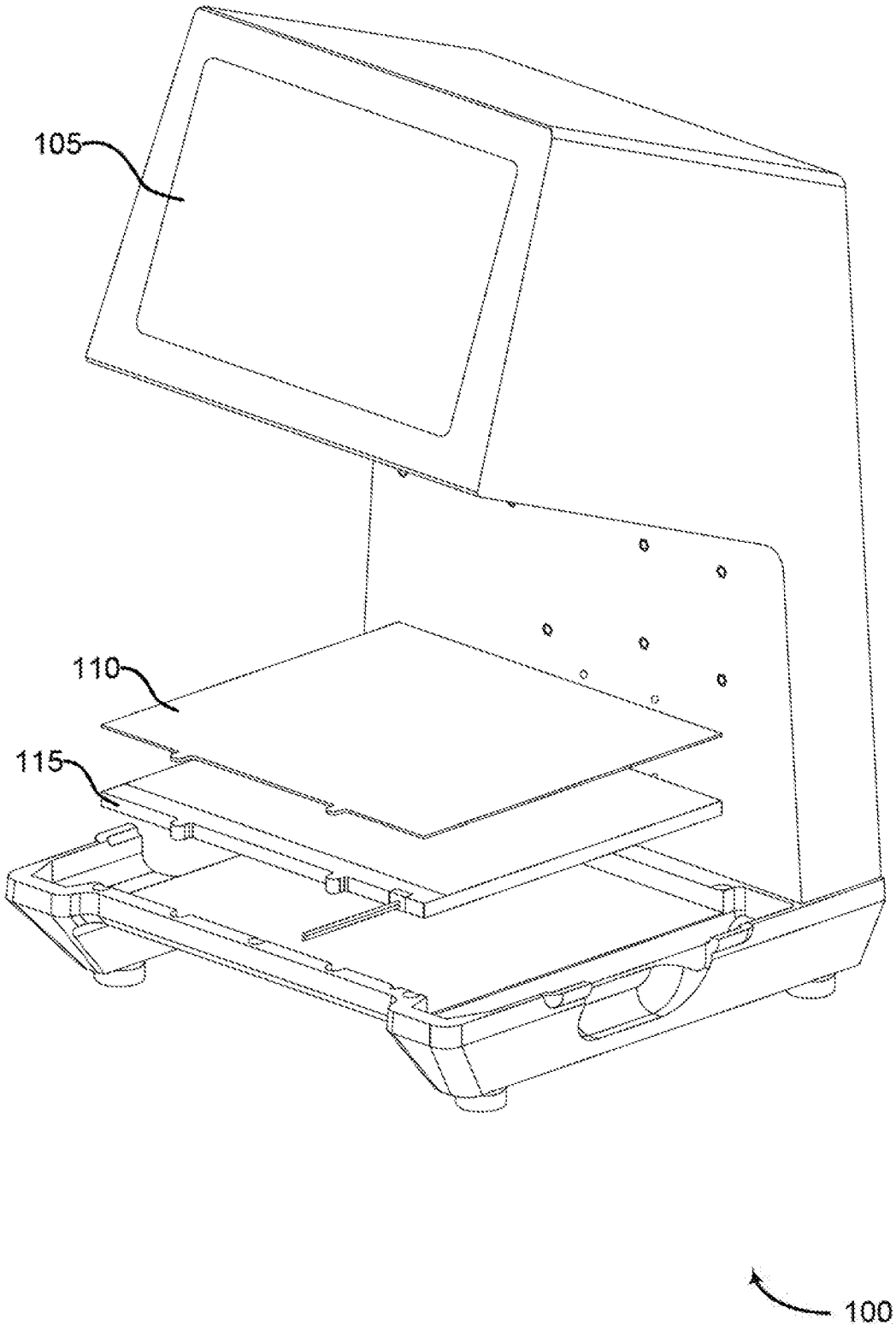
FIG. 1 shows an example of a perspective view of a counting apparatus in accordance with aspects of the present disclosure.

FIG. 1 shows an example of a perspective view of a counting apparatus 100 in accordance with aspects of the present disclosure. Counting apparatus 100 may include display 105, light diffuser 110, and light source 115. Counting apparatus 100 may be an example of, or include aspects of, the corresponding element or elements described with reference to FIGS. 2, 3, and 6.

Display 105 may display 105 a count of objects to a user (e.g., based at least in part on the determination that the count of the objects is reliable). Display 105 may also display an indication to a user that the count of the objects is not reliable. In some examples, the display 105 may comprise a touchscreen device capable of both displaying an image and receiving user input. Display 105 may be an example of, or include aspects of, the corresponding element or elements described with reference to FIG. 6.

Light diffuser 110 may be disposed between the light source 115 and the textured surface. The light diffuser 110 may diffuse light from the light source 115 to provide more consistent background light for the imaging process.

Light source 115 may be an example of, or include aspects of, the corresponding element or elements described with reference to FIG. 6. In some examples, the light source 115 may include a light emitting diode (LED), For example, an LED light source may produce light which is directed upward by an optical component (e.g., a holographic or mirror based optical component).

Figure 2:
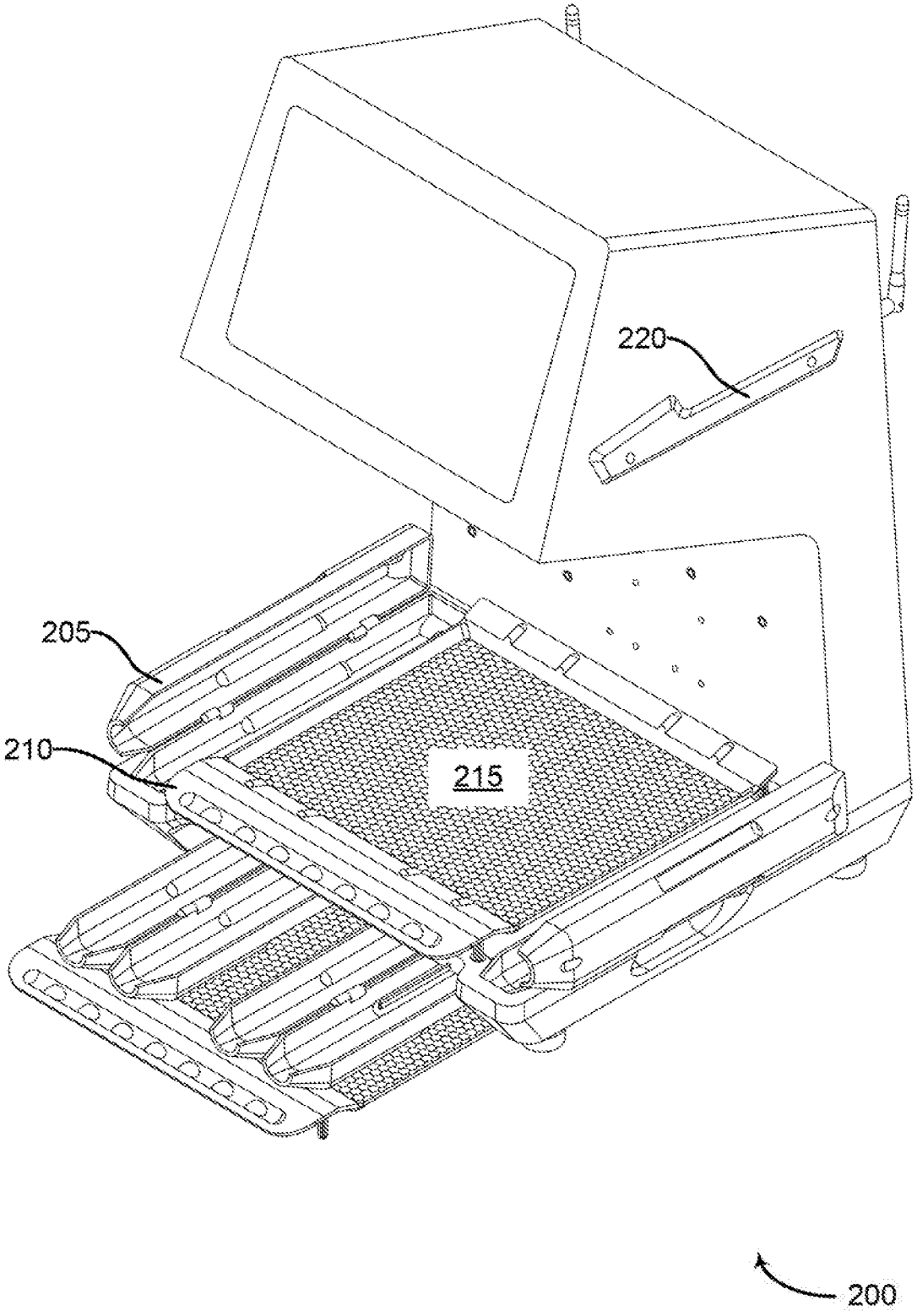
FIG. 2 shows an example of a counting apparatus with a removable tray in accordance with aspects of the present disclosure.

FIG. 2 shows an example of a counting apparatus 200 with a removable tray 210 in accordance with aspects of the present disclosure. Counting apparatus 200 may be an example of, or include aspects of, the corresponding element or elements described with reference to FIGS. 1, 3, and 6. Counting apparatus 200 may include chute 205, tray 210, textured surface 215, and sweeping knife 220.

In an example embodiment, a user may use the counting apparatus 200 to count pills for a patient at a pharmacy. The user may disperse pills or tablets from a supply bottle onto a tray 210 of the counting apparatus 200 in a scattering motion. The quantity dispersed may be higher than required (as some pills may then be set aside after an intermediate count).

The user may then apply a sweeping knife 220 to remove the excess pills into a the depository chutes 205. The counting apparatus 200 may then confirm and display the number of objects. The user may then tilt the tray 210 to place the required count into a second depository chute 205. The user may then remove the chute 205 containing the required number of pills and transfer the pills into a patient vial. The chute 205 containing the excess pills may also be removed, and the pills may be returned to the supply bottle.

The tray 210 may be configured with a textured surface 215 to facilitate an even distribution of objects (e.g., pills). For example, the texture of the tray 210 may include regular or irregularly spaced bumps, ridges, and troughs designed to create small spaces between the objects being counted (e.g., when pills are introduced onto the tray 210, or when the tray 210 is shaken or disturbed). In one embodiment, the texture comprises a regular hexagon tessellation. In other embodiments, the texture may comprise other suitable patterns. Thus, the textured surface 215 of the tray 210 may keep the pill or other objects separated from each other when dispersed. For example, the pattern may reduce rolling, heaping, and stacking of the pills.

Side walls of the tray 210 may be configured in a raised manner to eliminate overspills. The walls may be sloped on an angle to keep the pills in the processing field of view of the camera. In some examples, the tray 210 is not attached or clipped on to the counting apparatus 200, For example, the tray 210 may be removably suspended above the light table, supported on a number of round posts (e.g., 3 in front and 3 in back). The round posts may keep the tray 210 attached to the counting apparatus 200, while allowing the tray 210 to pivot left to right. The tray 210 may be easily removable for cleaning.

The counting apparatus 200 may also include a shaking mechanism (not shown) to distribute objects on the tray 210. For example, the shaking mechanism may include a camshaft mounted on a motor shaft to vibrate the tray 210 in order to disperse objects on the tray 210. When enabled, the motor may turn the camshaft, which may come in contact with a rear middle post of the tray 210 and causes the tray 210 to vibrate. The vibration intensity may vary either automatically or via a manual control. In some cases, the intensity of the vibration may depend on the size of the pills on the tray 210.

In some cases, the counting apparatus 200 may include two or more removable chutes 205. For example, a chute 205 on one side of the counting apparatus 200 may be used to collect pills that have counted. A separate chute 205 on the other side of the counting apparatus 200 may be used to collect pills that have been discarded, Thus, the chutes 205 may be situated on each side of the tray 210 and may be removably attached to the tray 210. The chutes 205 may be configured to assist in removing pills or tablets from the tray 210. The chutes 205 may also act as walls or barriers on the left and right side of the tray 210. Both chutes 205 may be easily removable (e.g., to collect the pills or for cleaning).

The sweeping knife 220 may be used to sweep or move pills or other objects from the tray 210 into a chute 205 (e.g., to prevent the pills from being counted or to collect pills after they have been counted). In some cases, the sweeping knife 220 may also be used to distribute objects on the tray 210 in a manner that is more conducive to counting (e.g., so that they do not overlap of form piles).

Chute 205 may be configured to collect one or more of the objects that have been counted. Chute 205 may also be configured to collect one or more of the objects that have been discarded. In some examples, the removeable tray 210 is affixed to the apparatus by one or more posts configured to enable the removeable tray 210 to pivot in at least one direction.

Textured surface 215 may be disposed between the light source and the visible light camera, wherein the textured surface 215 is configured to separate the objects. In some examples, the textured surface 215 comprises a plurality of raised portions and a plurality of lowered portions arranged in a regular pattern. In some examples, the regular pattern comprises a hexagonal tessellation pattern. In some examples, the textured surface 215 comprises a surface of a removable tray 210, In some cases, a user may place objects on a textured surface 215 to separate the objects. Textured surface 215 may be an example of, or include aspects of, the corresponding element or elements described with reference to FIG. 4.

Figure 3:
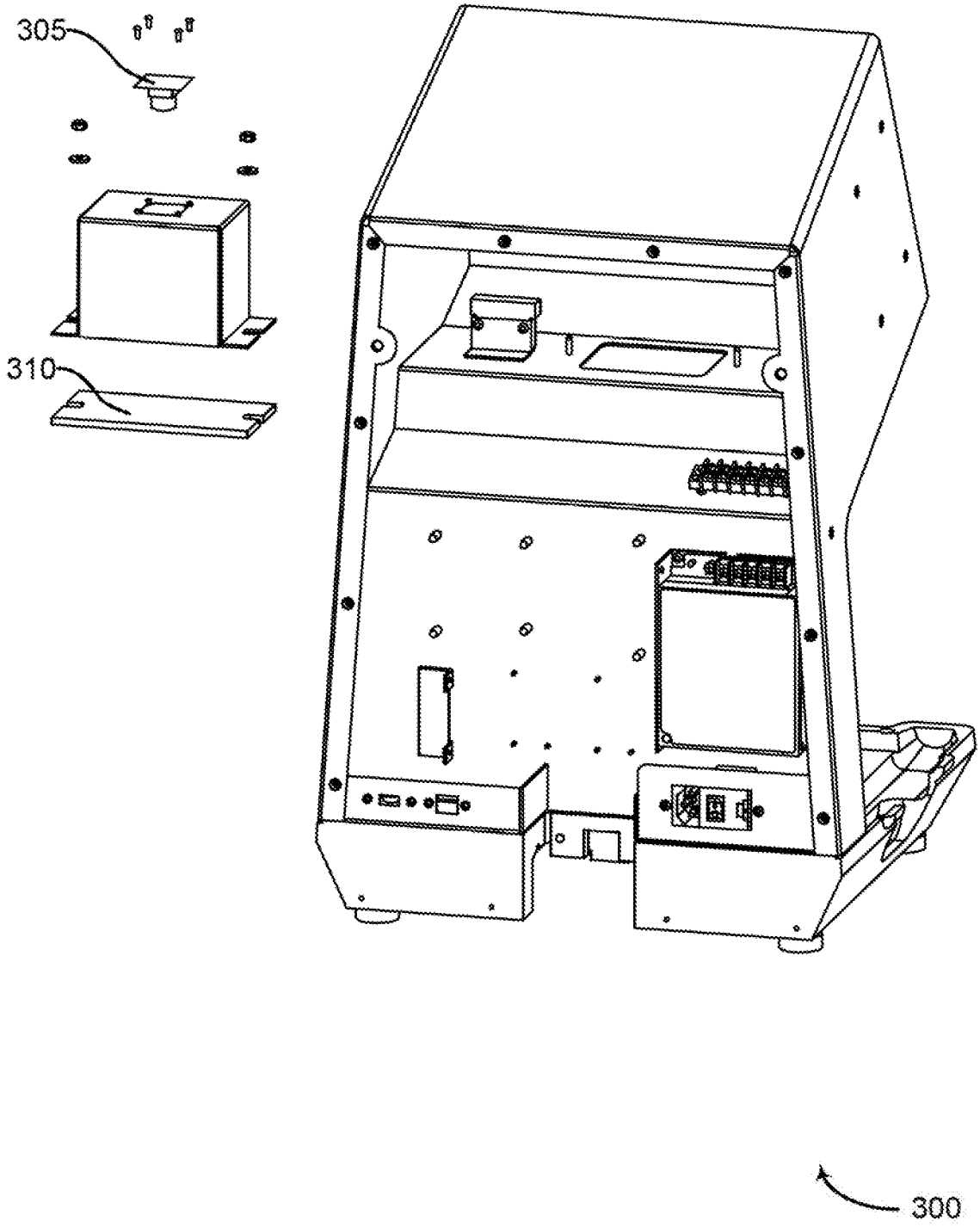
FIG. 3 shows an example of a rear view of a counting apparatus in accordance with aspects of the present disclosure.

FIG. 3 shows an example of a rear view of a counting apparatus 300 in accordance with aspects of the present disclosure, Counting apparatus 300 may be an example of, or include aspects of, the corresponding element or elements described with reference to FIGS. 1, 2, and 6. Counting apparatus 300 may include camera 305 and filter 310.

The camera 305 may comprise a visible light camera 305. Using a visible light camera 305 may help to reduce costs when compared to systems that utilize less common, or more complex optical components such as lasers and infrared cameras 305. The counting apparatus 300 may include other components, such as the textured tray, and utilize image processing techniques that facilitate the use of less expensive camera 305 equipment.

The filter 310 may comprise a bronze filter 310, or another optical filter 310 configured to filter 310 out external light reflected off of the objects located in the tray. That is, the filter 310 may be configured to allow a relatively high portion of light from the light source to reach the camera 305, while filtering out a relatively high portion of light from other sources. Camera 305 may be an example of, or include aspects of, the corresponding element or elements described with reference to FIG. 6.

Figure 4:
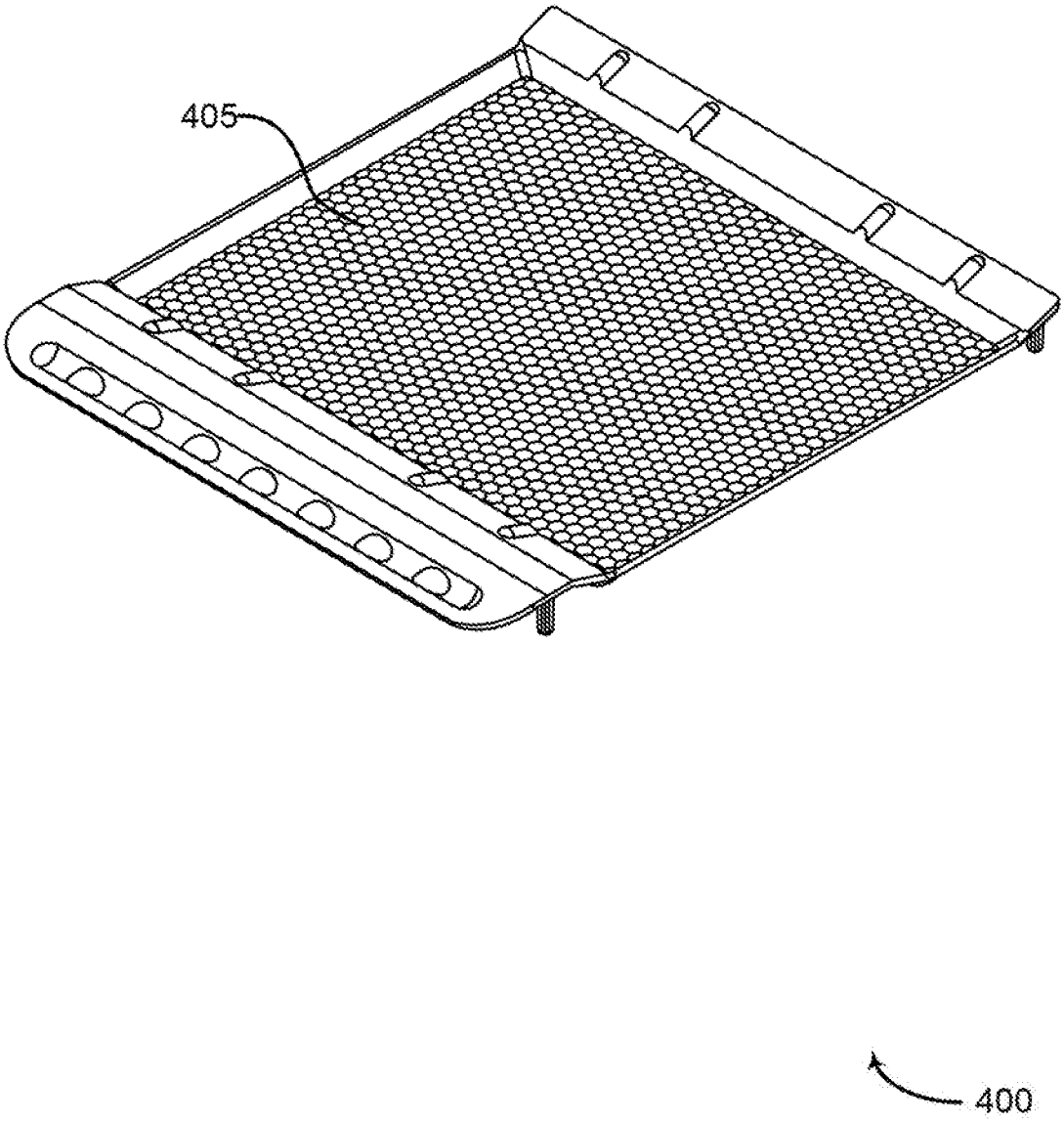
FIG. 4 shows an example of a removable tray in accordance with aspects of the present disclosure.

FIG. 4 shows an example of a removable tray 400 in accordance with aspects of the present disclosure. Removable tray 400 may include textured surface 405. Textured surface 405 may be an example of, or include aspects of, the corresponding element or elements described with reference to FIG. 2.

Figure 5:
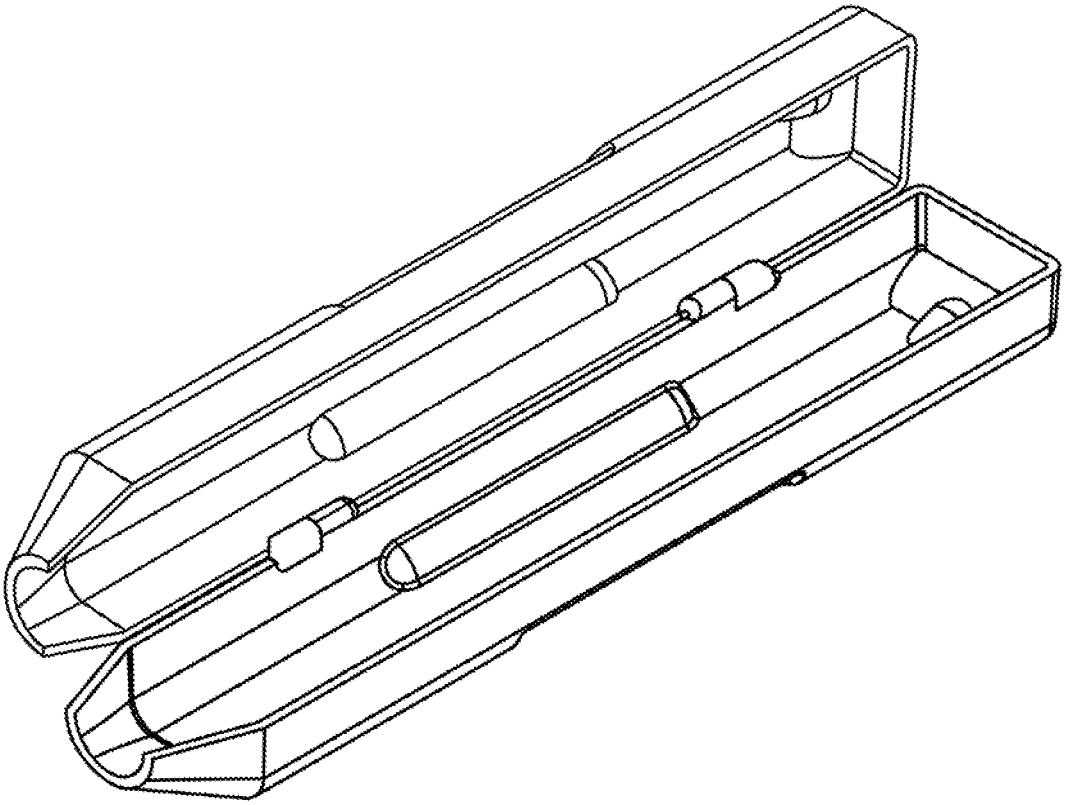
FIG. 5 shows an example of a removable chute in accordance with aspects of the present disclosure.

FIG. 5 shows an example of a removable chute 500 in accordance with aspects of the present disclosure. In some cases, a counting apparatus may include multiple removable chutes 500 (e.g., a first removable chute 500 on one side of the apparatus to collect discarded pills and another removable chute 500 on the other side to collect counted pills, as well as one or more reserve removable chutes 500).

Figure 6:
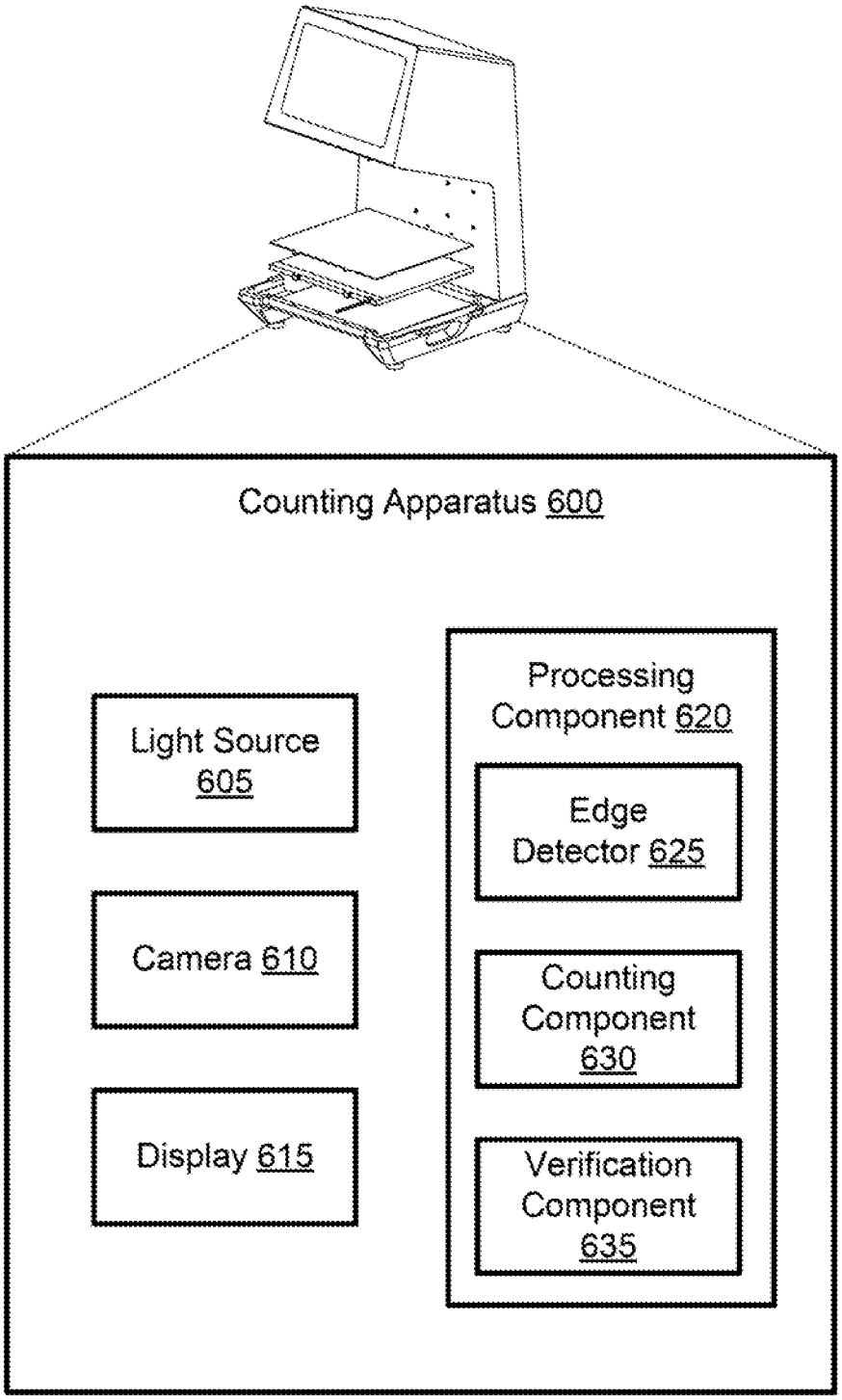
FIG. 6 shows an example of a block diagram of a counting apparatus in accordance with aspects of the present disclosure.

FIG. 6 shows an example of a block diagram of a counting apparatus 600 in accordance with aspects of the present disclosure. Counting apparatus 600 may be an example of, or include aspects of, the corresponding element or elements described with reference to FIGS. 1-3, Counting apparatus 600 may include light source 605, camera 610, display 615, and processing component 620.

Light source 605 may be an example of, or include aspects of, the corresponding element or elements described with reference to FIG. 1. Camera 610 may be an example of, or include aspects of, the corresponding element or elements described with reference to FIG. 3. Display 615 may be an example of, or include aspects of, the corresponding element or elements described with reference to FIG. 1.

Processing component 620 may include edge detector 625, counting component 630, and verification component 635, Processing component 620 may be configured to produce a count of the objects based at least in part on detecting regular convex contours within an image provided by the digital visible light camera 610.

Processing component 620 may identify one or more pixel groups, Processing component 620 may also determine that the one or more pixel groups are below a threshold size, Processing component 620 may also discard the one or more pixel groups based at least in part on the determination that the one or more pixel groups are below the threshold size, wherein determining the count of the objects is based at least in part on discarding the one or more pixel groups. Processing component 620 may also transform the electronic image to a black and white image, wherein the plurality of edges are detected based on the black and white image.

Edge detector 625 may identify a plurality of concave sections based at least in part on the plurality of edges. Edge detector 625 may also identify a plurality of regular convex contours based at least in part on the plurality of edges and the plurality concave sections. Edge detector 625 may also identify one or more closed edges of the plurality of edges. Edge detector 625 may also determine that the one or more closed edges are below a threshold size. Edge detector 625 may also discard the one or more closed edges based at least in part on the determination that the one or more closed edges are below the threshold size, wherein determining the count of the objects is based at least in part on discarding the one or more closed edges.

In some embodiments the edge detector 625 may operate based on the assumption that that the shadows of the objects being counted (e.g., the pills) will not be concave. That is, the edge detector 625 detects any concave parts of detected "blobs" in the image and then proceeds to process such places to distinguish single pills from the "blob" as a whole.

Counting component 630 may determine a count of the objects based at least in part on the plurality of regular convex contours and the determination of whether the image is suitable for counting. Counting component 630 may also determine an independent count of the objects based on each of the at least one additional electronic images, in some examples, the count of the objects is determined without reference to a geometric profile of the objects. In some examples, the count of the objects is determined without reference to a training set of objects.

Verification component 635 may determine whether the image is suitable for counting the objects based at least part on the plurality of regular convex contours. Verification component 635 may also determine whether the count of the objects and the independent counts of the objects are consistent, Verification component 635 may also determine whether the count of the objects is reliable based at least in part on whether the count of the objects and the independent counts of the objects are consistent. For example, verification component 635 may determine that the count of the objects is reliable. Verification component 635 may also determine that the count of the objects is not reliable.

For example, confidence in the count may be achieved by applying the same algorithm to multiple consecutive images and comparing the results. When the count is stable, the verification component 635 concludes the count is right. The reliability of the system may be improved when consecutive input images obtained from the camera are not exactly the same. Thus, the multiple detection passes will run a little bit different each time since the input is different. The number of verification images may be configurable and may, determine the confidence level.

Figure 7:
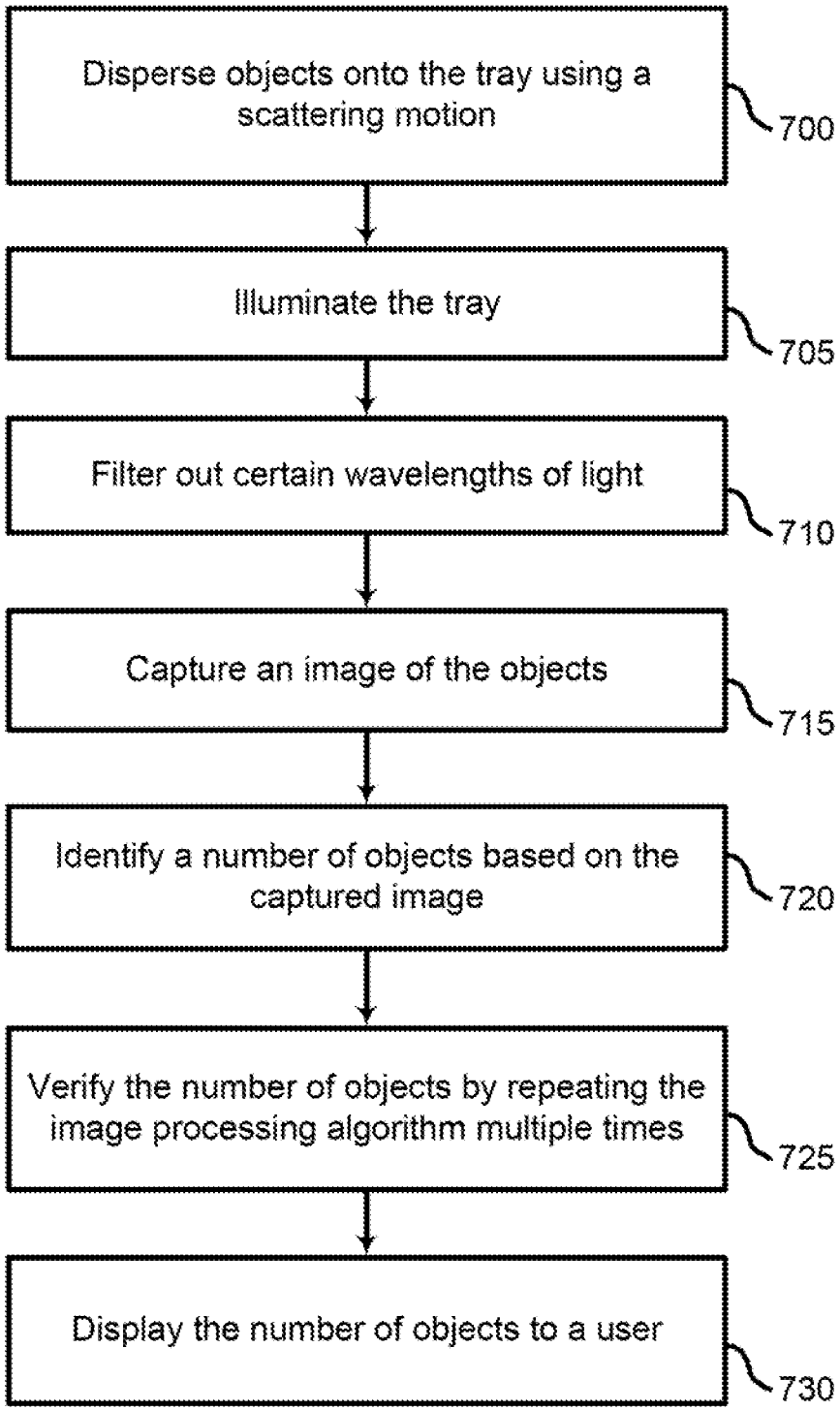
FIG. 7 shows an example of a process for counting objects in accordance with aspects of the present disclosure.

FIG. 7 shows an example of a process for counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps, or may be performed in conjunction with other operations described herein.

At step 700, the system or a user of the system may disperse objects onto the tray using a scattering motion. Preferably, the quantity dispersed should be equal to or higher higher than a desired quantity. The texture pattern on the tray may automatically cause the objects to disperse in a manner that leaves small gaps between the objects. These small gaps may enable an image processing algorithm to produce a more accurate count. However, in some cases the objects may still touch or slightly overlap each other.

At step 705, the system may illuminate the tray (including the objects) from below to create a high contrast between portions of the tray covered by an object, and portions of the tray that are not covered by an object.

At step 710, the system may filter out certain wavelengths of light in order to better distinguish light from the light source and light from external sources (e.g., reflections from the objects on the tray). While using a filter is an optional step, it may be particularly useful when counted objects that are glossy or reflective.

At step 715, the system may capture an image of the objects. For example, the image may include a visible light image captured with a relatively inexpensive camera. The image may capture outlines or shadows of the objects produced by the light source such that the objects appear black over a white surface of the tray. In some cases the captured image may be a black and white image, or may be transformed into a black and white image prior to further processing.

At step 720, the system may identify a number of objects based on the captured image. The number of objects may be determined using on an object recognition algorithm based on detecting edges and hollows within the image, where a hollow may include a bend in an edge (i.e., a concave portion of an edge).

At step 725, the system may verify the number of objects by repeating the image processing algorithm multiple times. If the result is consistent over multiple attempts (e.g., over five attempts) then the number may be verified. In some cases, the image processing algorithm is repeated using different camera images.

At step 730, the system may display the number of objects to a user. In some cases, if the number of objects cannot be determined or verified, the display may include an indication that the objects should be redistributed.

Figure 8:
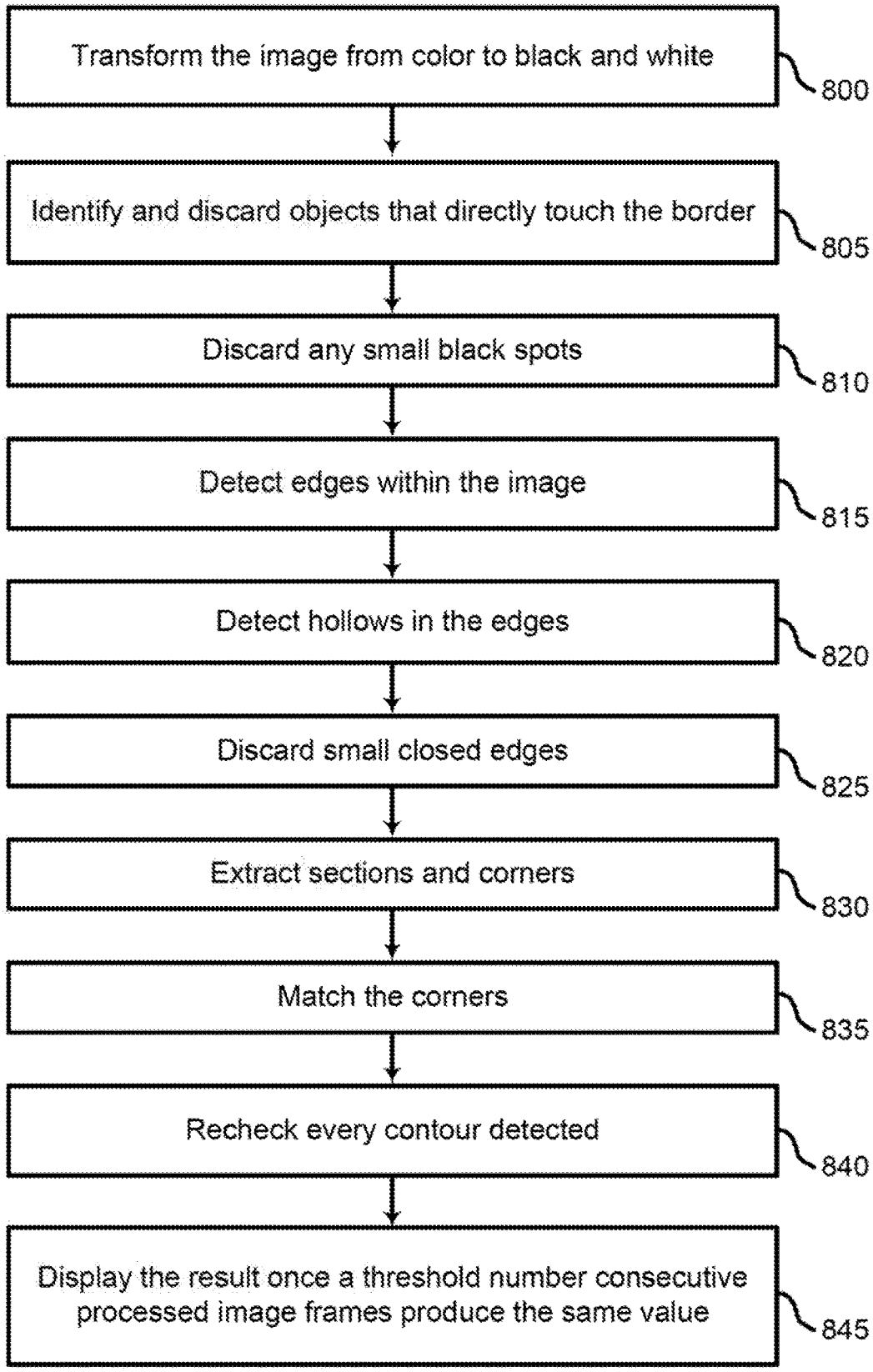

FIG. 8 shows an example of a method for processing an image to count objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps, or may be performed in conjunction with other operations described herein.

At step 800, the system may transform the image from color to black and white.

At step 805, the system may identify and discard objects that directly touch the border which defines the field of view.

At step 810, the system may discard any small black spots (e.g., spots that include only a few pixels).

At step 815, the system may detect edges within the image (i.e., detect black pixels which directly join at least one white pixel).

At step 820, the system may detect hollows in the edges (i.e., detect all bends in the edges which make a shape concave).

At step 825, the system may discard small closed edges.

At step 830, the system may extract sections (regular contours) and corners (start/end of a hollow).

At step 835, the system may match corners to make regular convex contours.

At step 840, the system may recheck every contour detected. If all of the contours are closed and convex, then the image has been successfully processed. If not the result is discarded.

At step 845, the system may display the result once a threshold number (e.g., 5) consecutive processed image frames produce the same value.

Figure 9:
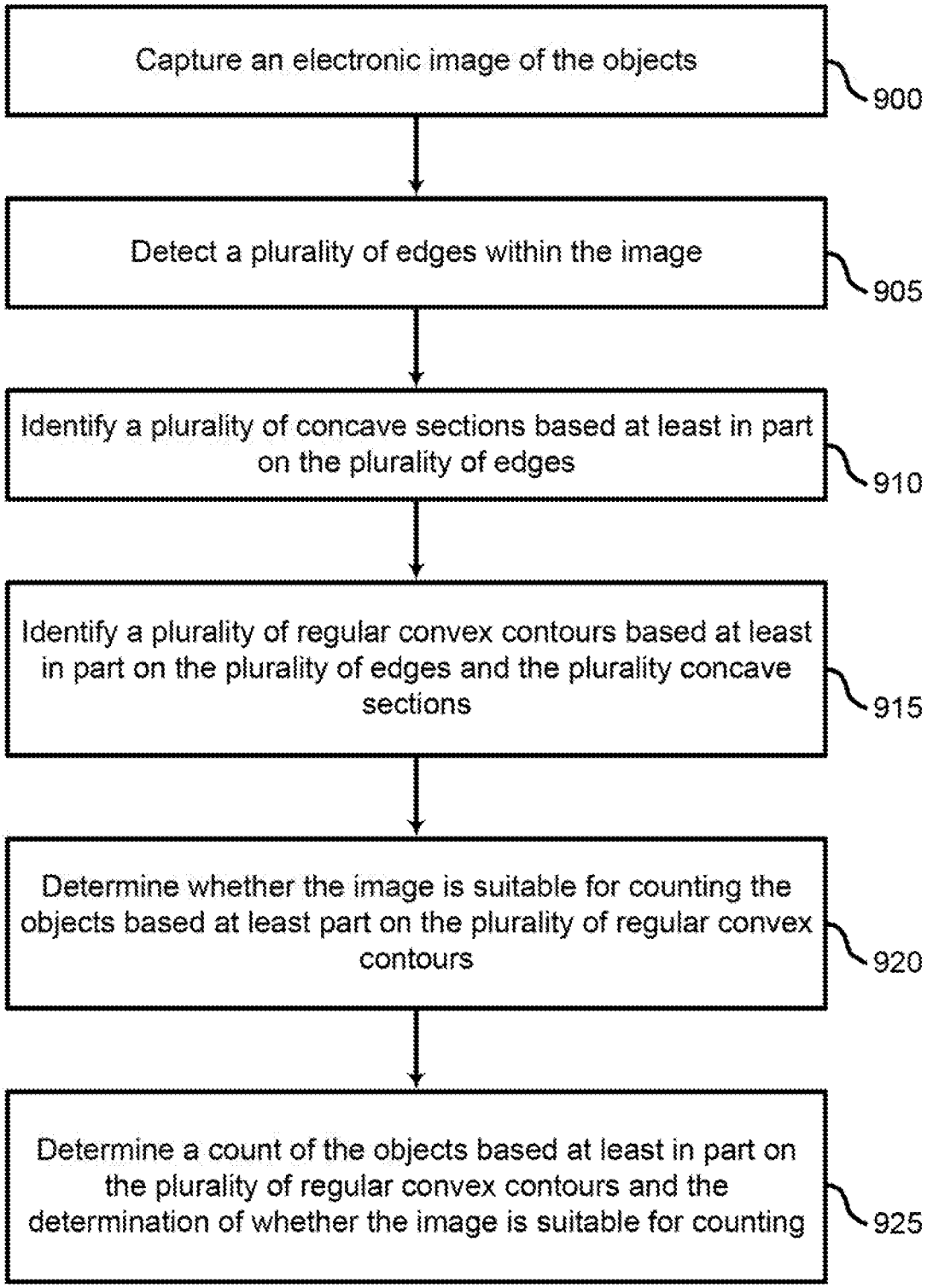
FIGS. 9 through 13 show examples of a process for counting objects in accordance with aspects of the present disclosure.

FIG. 9 shows an example of a process for counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps, or may be performed in conjunction with other operations described herein.

At step 900, the system may capture an electronic image of the objects. In some cases, the operations of this step may refer to, or be performed by, a camera as described with reference to FIGS. 3 and 6.

At step 905, the system may detect a plurality of edges within the image. In some cases, the operations of this step may refer to, or be performed by, an edge detector as described with reference to FIG. 6.

At step 910, the system may identify a plurality of concave sections based at least in part on the plurality of edges. In some cases, the operations of this step may refer to, or be performed by, an edge detector as described with reference to FIG. 6.

At step 915, the system may identify a plurality of regular convex contours based at least in part on the plurality of edges and the plurality concave sections. In some cases, the operations of this step may refer to, or be performed by, an edge detector as described with reference to FIG. 6.

At step 920, the system may determine whether the image is suitable for counting the objects based at least part on the plurality of regular convex contours. In some cases, the operations of this step may refer to, or be performed by, a verification component as described with reference to FIG. 6.

At step 925, the system may determine a count of the objects based at least in part on the plurality of regular convex contours and the determination of whether the image is suitable for counting. In some cases, the operations of this step may refer to, or be performed by, a counting component as described with reference to FIG. 6.

Figure 10:
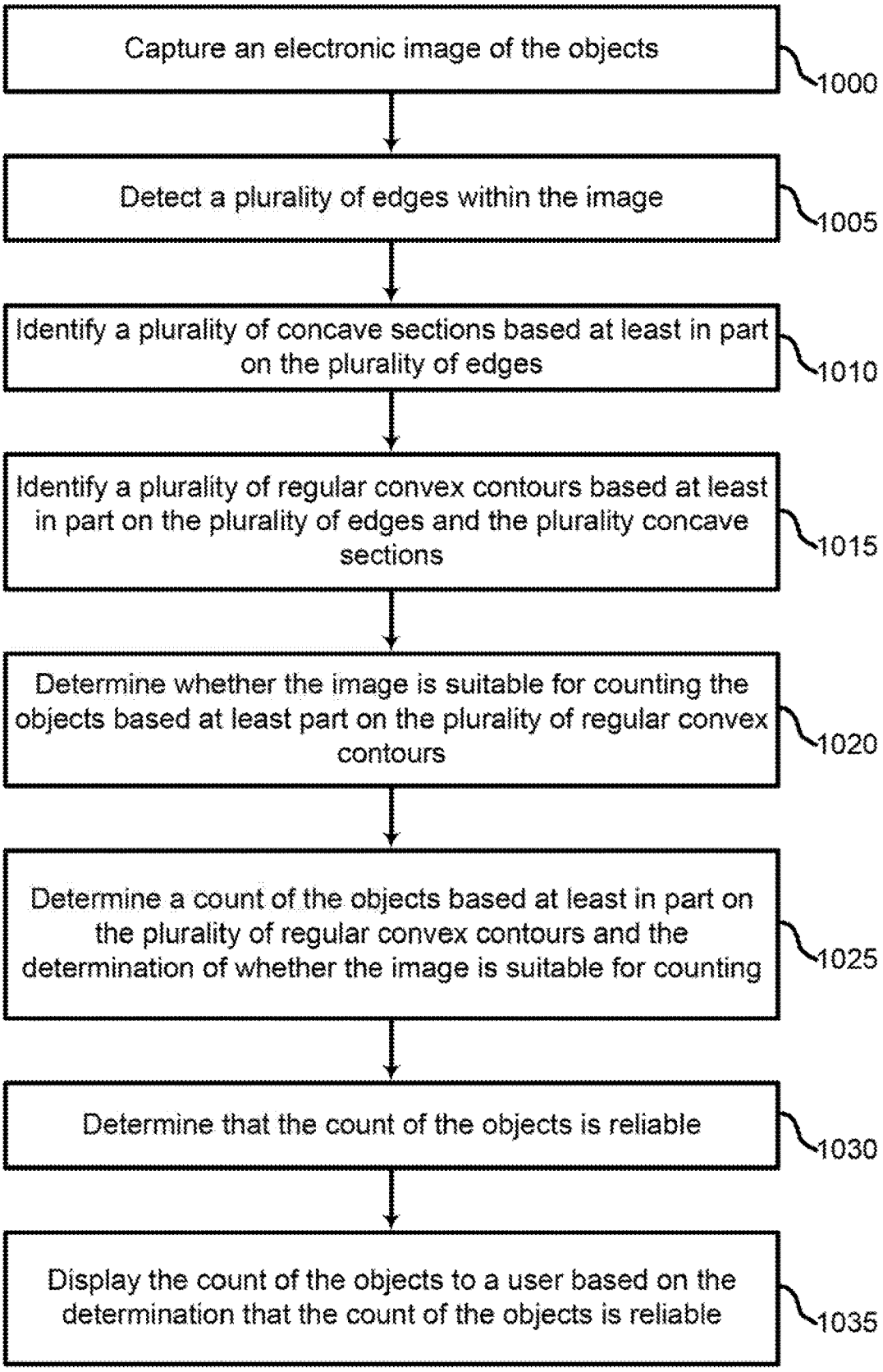

FIG. 10 shows an example of a process for counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be perfumed according to the methods and processes described in accordance with aspects of the present disclosure. For example, the operations may be composed of various sub-steps, or may be performed in conjunction with other operations described herein.

At step 1000, the system may capture an electronic image of the objects. In some cases, the operations of this step may refer to, or be performed by, a camera as described with reference to FIGS. 3 and 6.

At step 1005, the system may detect a plurality of edges within the image. In some cases, the operations of this step may refer to, or be performed by, an edge detector as described with reference to FIG. 6.

At step 1010, the system may identify a plurality of concave sections based at least in part on the plurality of edges. In some cases, the operations of this step may refer to, or be performed by, an edge detector as described with reference to FIG. 6.

At step 1015, the system may identify a plurality of regular convex contours based at least in part on the plurality of edges and the plurality concave sections. In some cases, the operations of this step may refer to, or be performed by, an edge detector as described with reference to FIG. 6.

At step 1020, the system may determine whether the image is suitable for counting the objects based at least part on the plurality of regular convex contours. In some cases, the operations of this step may refer to, or be performed by, a verification component as described with reference to FIG. 6.

At step 1025, the system may determine a count of the objects based at least in part on the plurality of regular convex contours and the determination of whether the image is suitable for counting. In some cases, the operations of this step may refer to, or be performed by, a counting component as described with reference to FIG. 6.

At step 1030, the system may determine that the count of the objects is reliable. In some cases, the operations of this step may refer to, or be performed by, a verification component as described with reference to FIG. 6.

At step 1035, the system may display the count of the objects to a user based at least in part on the determination that the count of the objects is reliable, in some cases, the operations of this step may refer to, or be performed by, a display as described with reference to FIGS. 1 and 6.

Figure 11:
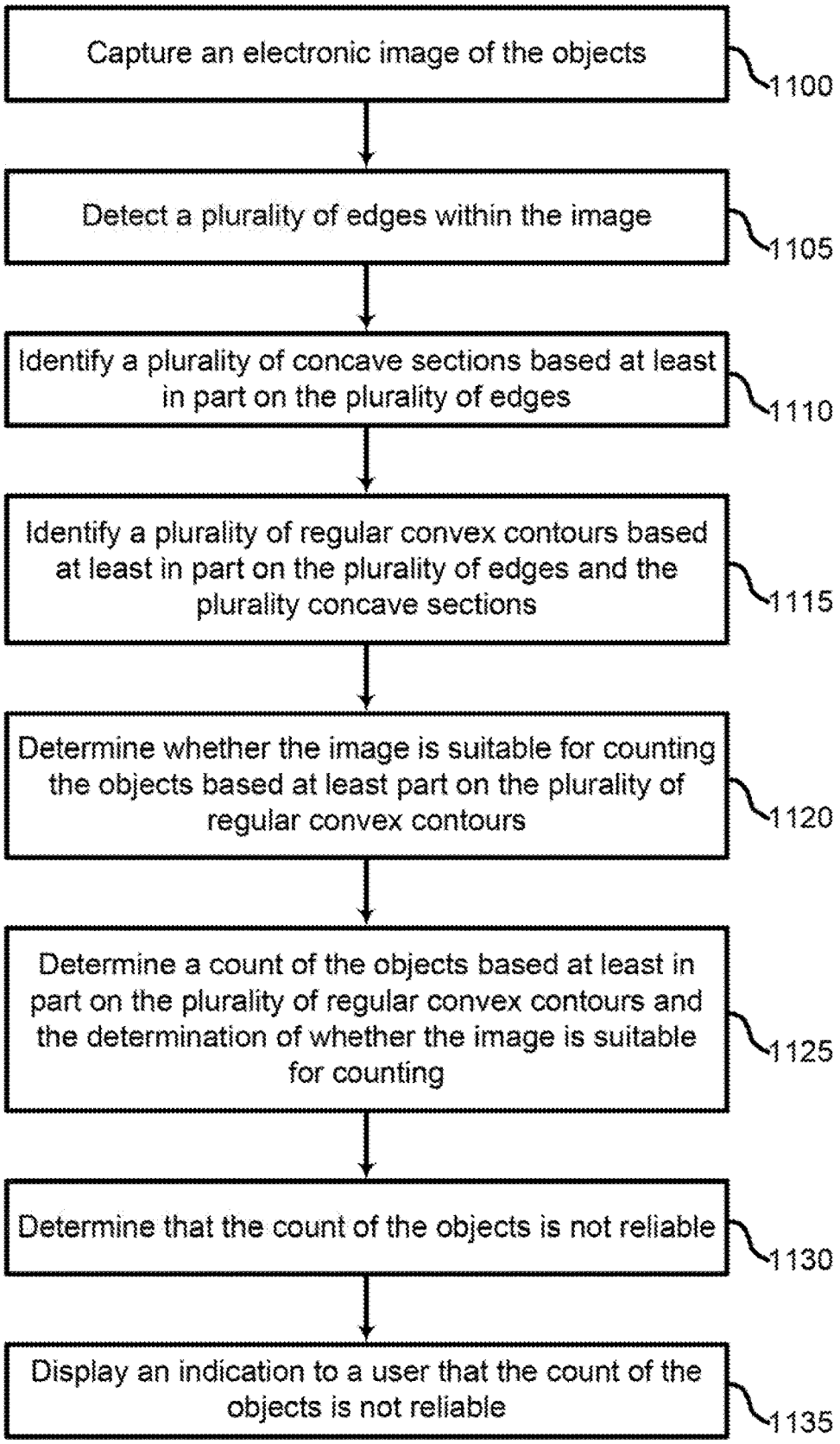

FIG. 11 shows an example of a process tier counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various sub-steps, or may be performed in conjunction with other operations described herein.

At step 1100, the system may capture an electronic image of the objects. In some cases, the operations of this step may refer to, or be performed by, a camera as described with reference to FIGS. 3 and 6.

At step 1105, the system may detect a plurality of edges within the image. In some cases, the operations of this step may refer to, or be performed by, an edge detector as described with reference to FIG. 6.

At step 1110, the system may identify a plurality of concave sections based at least in part on the plurality of edges. In some cases, the operations of this step may refer to, or be performed by, an edge detector as described with reference to FIG. 6.

At step 1115, the system may identify a plurality of regular convex contours based at least in part on the plurality of edges and the plurality concave sections. In some cases, the operations of this step may refer to, or be performed by, an edge detector as described with reference to FIG. 6.

At step 1120, the system may determine whether the image is suitable for counting the objects based at least part on the plurality of regular convex contours. In some cases, the operations of this step may refer to, or be performed by, a verification component as described with reference to FIG. 6.

At step 1125, the system may determine a count of the objects based at least in part on the plurality of regular convex contours and the determination of whether the image is suitable for counting. In some cases, the operations of this step may refer to, or be performed by, a counting component as described with reference to FIG. 6.

At step 1130, the system may determine that the count of the objects is not reliable. In some cases, the operations of this step may refer to, or be performed by, a verification component as described with reference to FIG. 6.

At step 1135, the system may display an indication to a user that the count of the objects is not reliable. In some cases, the operations of this step may refer to, or be performed by, a display as described with reference to FIGS. 1 and 6.

Figure 12:
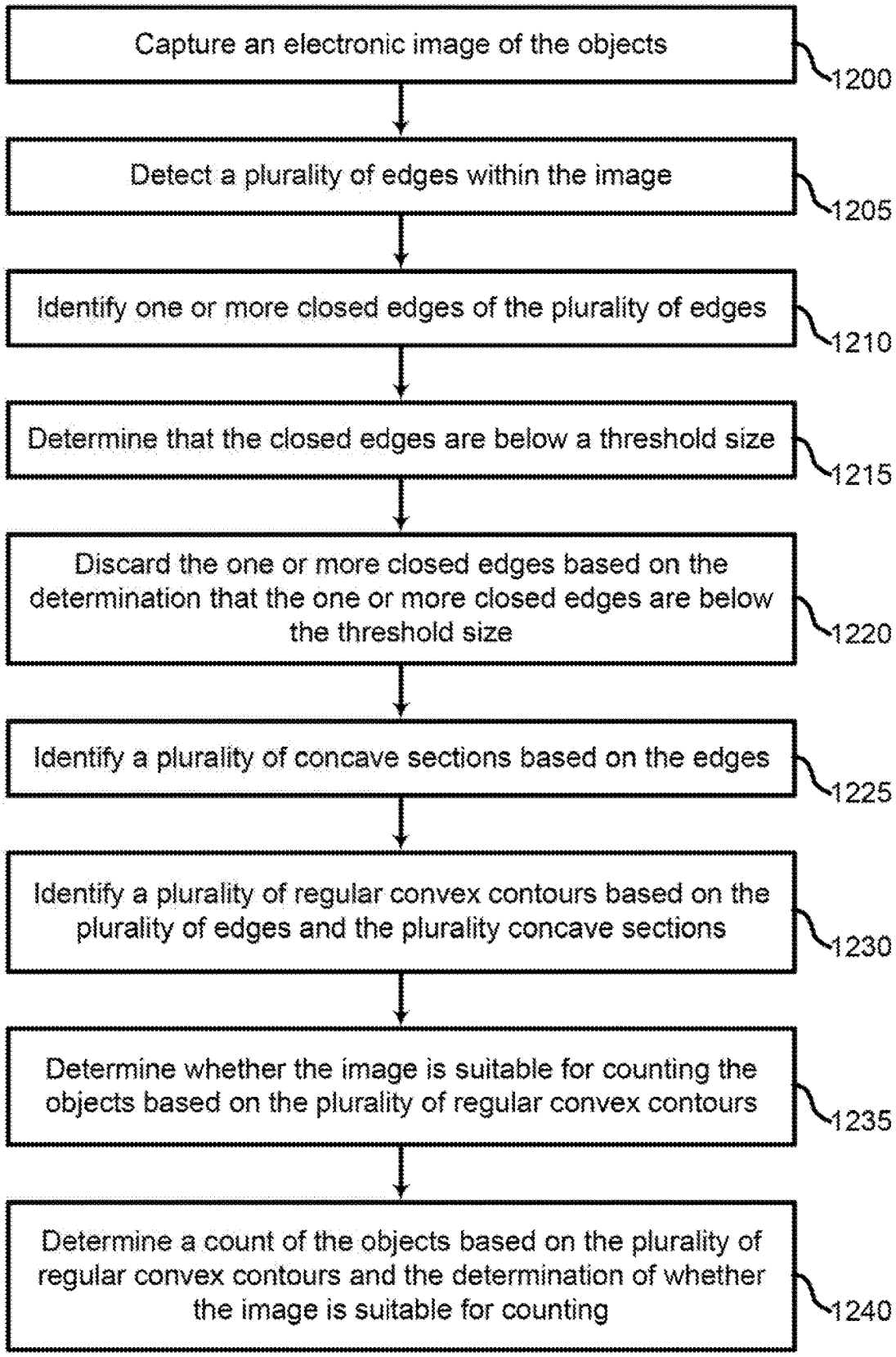

FIG. 12 shows an example of a process for counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various sub-steps, or may be performed in conjunction with other operations described herein.

At step 1200, the system may capture an electronic image of the objects. In some cases, the operations of this step may refer to, or be performed by, a camera as described with reference to FIGS. 3 and 6.

At step 1205, the system may detect a plurality of edges within the image. In some cases, the operations of this step may refer to, or be performed by, an edge detector as described with reference to FIG. 6.

At step 1210, the system may identify one or more closed edges of the plurality of edges. In some cases, the operations of this step may refer to, or be performed by, an edge detector as described with reference to FIG. 6.

At step 1215, the system may determine that the one or more closed edges are below a threshold size. In some cases, the operations of this step may refer to, or be performed by, an edge detector as described with reference to FIG. 6.

At step 1220, the system may discard the one or more closed edges based at least in part on the determination that the one or more closed edges are below the threshold size. In some cases, the operations of this step may refer to, or be performed by, an edge detector as described with reference to FIG. 6.

At step 1225, the system may identify a plurality of concave sections based at least in part on the plurality of edges. In some cases, the operations of this step may refer to, or be performed by, an edge detector as described with reference to FIG. 6.

At step 1230, the system may identify a plurality of regular convex contours based at least in part on the plurality of edges and the plurality concave sections. In some cases, the operations of this step may refer to, or be performed by, an edge detector as described with reference to FIG. 6.

At step 1235, the system may determine whether the image is suitable for counting the objects based at least part on the plurality of regular convex contours. In some cases, the operations of this step may refer to, or be performed by, a verification component as described with reference to FIG. 6.

At step 1240, the system may determine a count of the objects based at least in part on the plurality of regular convex contours and the determination of whether the image is suitable for counting. In some cases, the operations of this step may refer to, or be performed by, a counting component as described with reference to FIG. 6.

Figure 13:
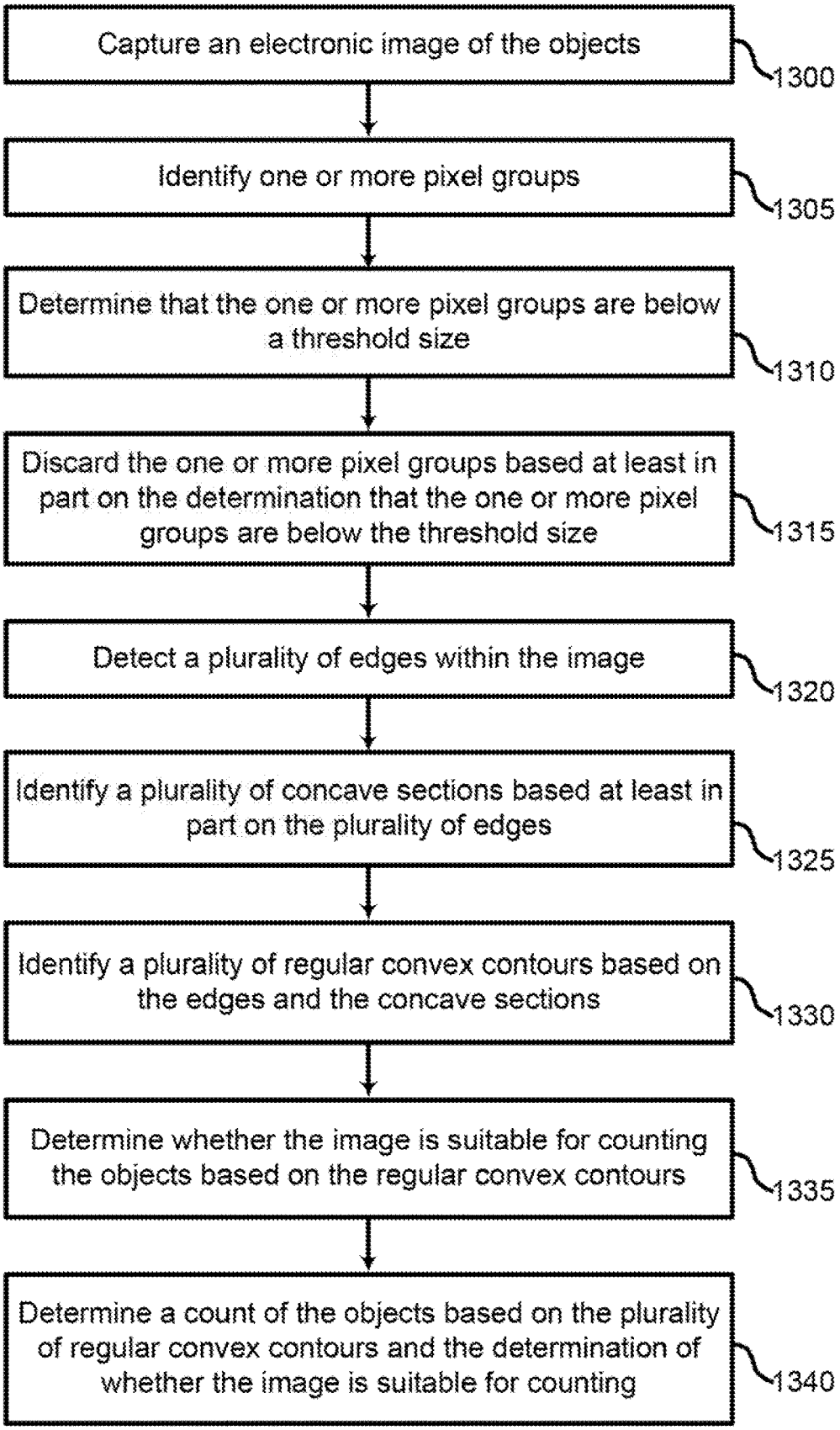

FIG. 13 shows an example of a process for counting objects in accordance with aspects of the present disclosure. In some examples, these operations may be performed by a system including a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various sub-steps, or may be performed in conjunction with other operations described herein.

At step 1300, the system may capture an electronic image of the objects. In some cases, the operations of this step may refer to, or be performed by, a camera as described with reference to FIGS. 3 and 6.

At step 1305, the system may identify one or more pixel groups. In some cases, the operations of this step may refer to, or be performed by, a processing component as described with reference to FIG. 6.

At step 1310, the system may determine that the one or more pixel groups are below a threshold size. In some cases, the operations of this step may refer to, or be performed by, a processing component as described with reference to FIG. 6.

At step 1315, the system may discard the one or more pixel groups based at least in part on the determination that the one or more pixel groups are below the threshold size. In some cases, the operations of this step may refer to, or be performed by, a processing component as described with reference to FIG. 6.

At step 1320, the system may detect a plurality of edges within the image. In some cases, the operations of this step may refer to, or be performed by, an edge detector as described with reference to FIG. 6.

At step 1325, the system may identify a plurality of concave sections based at least in part on the plurality of edges. In some cases, the operations of this step may refer to, or be performed by, an edge detector as described with reference to FIG. 6.

At step 1330, the system may identify a plurality of regular convex contours based at least in part on the plurality of edges and the plurality concave sections. In some cases, the operations of this step may refer to, or be performed by, an edge detector as described with reference to FIG. 6.

At step 1335, the system may determine whether the image is suitable for counting the objects based at least part on the plurality of regular convex contours. In some cases, the operations of this step may refer to, or be performed by, a verification component as described with reference to FIG. 6.

At step 1340, the system may determine a count of the objects based at least in part on the plurality of regular convex contours and the determination of whether the image is suitable for counting. In some cases, the operations of this step may refer to, or be performed by, a counting component as described with reference to FIG. 6.

The description and drawings described herein represent example configurations and do not represent all the implementations within the scope of the claims. For example, the operations and steps may be rearranged, combined or otherwise modified. Also, structures and devices may be represented in the form of block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein, but is to be accorded the broadest scope consistent with the principles and novel features disclosed herein.

The described methods may be implemented or performed by devices that include a general-purpose processor, a digital signal processor (DSP), an application specific integrated circuit (ASIC), a field programmable gate array (FPGA) or other programmable logic device, discrete gate or transistor logic, discrete hardware components, or any combination thereof. A general-purpose processor may be a microprocessor, a conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration). Thus, the functions described herein may be implemented in hardware or software and may be executed by a processor, firmware, or any combination thereof. If implemented in software executed by a processor, the functions may be stored in the form of instructions or code on a computer-readable medium.

Computer-readable media includes both non-transitory computer storage media and communication media including any medium that facilitates transfer of code or data. A non-transitory storage medium may be any available medium that can be accessed by a computer. For example, non-transitory computer-readable media can comprise random access memory (RAM), read-only memory (ROM), electrically erasable programmable read-only memory (EEPROM), compact disk (CD) or other optical disk storage, magnetic disk storage, or any other non-transitory medium for carrying or storing data or code.

Also, connecting components may be properly termed computer-readable media. For example, if code or data is transmitted from a website, server, or other remote source using a coaxial cable, fiber optic cable, twisted pair, digital subscriber line (DSL), or wireless technology such as infrared, radio, or microwave signals, then the coaxial cable, fiber optic cable, twisted pair, DSL, or wireless technology are included in the definition of medium. Combinations of media are also included within the scope of computer-readable media.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on."

What is claimed is:

1. An apparatus for counting objects, comprising:
a light source;
a digital camera;
a textured surface disposed between the light source and the digital camera, wherein the textured surface is configured to separate the objects;
a processing component configured to produce a count of the objects based at least in part on detecting regular convex contours within an image provided by the digital camera; and
a display configured to show the count of the objects.

2. The apparatus of claim 1, further comprising:
a light diffuser disposed between the light source and the textured surface.

3. The apparatus of claim 1, wherein:
the textured surface comprises a plurality of raised portions and a plurality of lowered portions arranged in a regular pattern.

4. The apparatus of claim 1, further comprising:
a first removable chute configured to collect one or more of the objects that have been counted and a second removeable chute configured to collect one or more of the objects that have been discarded.

5. The apparatus of claim 1, wherein:
the textured surface comprises a surface of a removable tray, and the removeable tray is affixed to the apparatus by one or more posts configured to enable the removeable tray to pivot in at least one direction.

6. The apparatus of claim 1, further comprising:
a filter disposed between the textured surface and the digital camera, wherein the filter is configured to filter out a first portion of reflected light and pass through a second portion of light from the light source, and wherein the portion comprises a higher ratio than the second portion.

7. The apparatus of claim 1, wherein:
the digital camera comprises a visible light camera.

8. A method for counting objects, comprising:
capturing an electronic image of the objects;
detecting a plurality of edges within the image;
identifying a plurality of concave sections based at least in part on the plurality of edges;
identifying a plurality of regular convex contours based at least in part on the plurality of edges and the plurality concave sections;
determining whether the image is suitable for counting the objects based at least part on the plurality of regular convex contours; and
determining a count of the objects based at least in part on the plurality of regular convex contours and the determination of whether the image is suitable for counting.

9. The method of claim 8, further comprising:
placing the objects on a textured surface configured to separate the objects.

10. The method of claim 8, further comprising:
capturing at least one additional electronic image of the objects;
determining an independent count of the objects based on each of the at least one additional electronic images;
determining whether the count of the objects and the independent counts of the objects are consistent; and
determining whether the count of the objects is reliable based at least in part on whether the count of the objects and the independent counts of the objects are consistent.

11. The method of claim 8, further comprising:
determining that the count of the objects is reliable; and
displaying the count of the objects to a user based at least in part on the determination that the count of the objects is reliable.

12. The method of claim 11, further comprising:
displaying an indication that the count is reliable other than the count of the objects.

13. The method of claim 8, further comprising:
determining that the count of the objects is not reliable; and
displaying an indication to a user that the count of the objects is not reliable.

14. The method of claim 13, further comprising:
performing a separation action on the objects based at least in part on the determination that the count of the objects is not reliable.

15. The method of claim 8, further comprising:
identifying one or more closed edges of the plurality of edges;
determining that the one or more closed edges are below a threshold size; and
discarding the one or more closed edges based at least in part on the determination that the one or more closed edges are below the threshold size, wherein determining the count of the objects is based at least in part on discarding the one or more closed edges.

16. The method of claim 8, further comprising:
identifying one or more pixel groups;
determining that the one or more pixel groups are below a threshold size; and
discarding the one or more pixel groups based at least in part on the determination that the one or more pixel groups are below the threshold size, wherein determining the count of the objects is based at least in part on discarding the one or more pixel groups.

17. The method of claim 8, wherein:
the count of the objects is determined without reference to a geometric profile of the objects.

18. The method of claim 8, wherein:
the count of the objects is determined without reference to a training set of objects.

19. The method of claim 8, further comprising:
transforming the electronic image to a black and white image, wherein the plurality of edges are detected based on the black and white image.

20. An apparatus for counting objects, comprising: a processor and a memory storing instructions and in electronic communication with the processor, the processor being configured to execute the instructions to:
capture an electronic image of the objects;
detect a plurality of edges within the image;
identify a plurality of concave sections based at least in part on the plurality of edges;
identify a plurality of regular convex contours based at least in part on the plurality of edges and the plurality concave sections;

determine whether the image is suitable for counting the objects based at least part on the plurality of regular convex contours; and determine a count of the objects based at least in part on the plurality of regular convex contours and the determination of whether the image is suitable for counting.

* * * * *